US012662779B2

(12) United States Patent
Van Meter

(10) Patent No.: US 12,662,779 B2
(45) Date of Patent: Jun. 23, 2026

(54) SYSTEM FOR CONVERTING EXISTING RAILROAD TRACKS TO TRAILS

(71) Applicant: Brad Van Meter, Greenville, SC (US)

(72) Inventor: Brad Van Meter, Greenville, SC (US)

( * ) Notice: Subject to any disclaimer, the term of this patent is extended or adjusted under 35 U.S.C. 154(b) by 754 days.

(21) Appl. No.: 17/959,867

(22) Filed: Oct. 4, 2022

(65) Prior Publication Data

US 2023/0105715 A1 Apr. 6, 2023

Related U.S. Application Data

(60) Provisional application No. 63/252,194, filed on Oct. 5, 2021.

(51) Int. Cl.
*E01C 15/00* (2006.01)
*E01C 5/00* (2006.01)

(52) U.S. Cl.
CPC ..... *E01C 15/00* (2013.01); *E01C 5/001* (2013.01)

(58) Field of Classification Search
CPC . E01B 2/00; E01B 26/00; E01C 5/001; E01C 5/005; E01C 9/04; E01C 1/222; E01C 1/225; E01C 15/00
See application file for complete search history.

(56) References Cited

FOREIGN PATENT DOCUMENTS

| | | | | | |
|---|---|---|---|---|---|
| DE | 3809515 | A1 | * | 11/1998 | ..... E01C 15/00 |
| DE | 19724833 | A1 | * | 12/1998 | ..... E01D 22/00 |
| DE | 20020443 | U1 | * | 2/2001 | ..... E01C 9/00 |
| DE | 10158720 | A1 | * | 6/2002 | ..... E01C 15/00 |
| DE | 10208938 | A1 | * | 10/2003 | ..... E01C 15/00 |
| FR | 2808292 | A1 | * | 11/2001 | ..... E01B 26/00 |
| GB | 2333311 | A | * | 7/1999 | ..... E01C 9/04 |
| KR | 20220109841 | A | * | 8/2022 | ..... E01B 9/68 |

* cited by examiner

*Primary Examiner* — Gary S Hartmann
(74) *Attorney, Agent, or Firm* — Kim and Lahey Law Firm, LLC; Seann P. Lahey; Douglas W. Kim

(57) ABSTRACT

A trail mat system for converting existing railroad tracks to trails. The system includes a mat extending between and on top of a pair of railroad track rails. At least one rail clamp section is disposed on a bottom side of the mat and includes a rail cavity for receiving at least a portion of the rails. At least one clamp arm is included in the rail clamp section for engaging one of the rails. A securing fastener is operatively associated with the at least one clamp arm to bias the clamp arm against the rail to prevent separation of the mat from the rails. The mat is configured to be placed over and removably secured to the rails to provide a trail surface overtop the rails without removing the rails or other elements of the railroad track.

15 Claims, 9 Drawing Sheets

SYSTEM FOR CONVERTING EXISTING RAILROAD TRACKS TO TRAILS

BACKGROUND OF THE INVENTION

1) Field of the Invention

The present system is directed to a revitalization and/or reuse of railroad tracks for providing trails for public and private use and access to areas surrounding the previous railroad tracks. This system is useful for the movement of rails-to-trails where abandoned train tracks are transformed to trails for community use while preserving the ability to quickly and easily remove the trail system and return the railroad track to operation if needed.

2) Description of the Related Art

Historically, transportation of mass individuals and goods has utilized railways and trains. Railroads have played a large role in the industrial and commercial development of the United States from the industrial revolution in the North-east to the settlement of the West. The American railroad surge began with the founding of the first passenger and freight line in the nation of the Baltimore and Ohio Railroad in 1827 and beginning of a long construction project to provide rail transportation westward over the obstacles of the Appalachian Mountains eastern chain. However, the use of railways declined with the invention and adoption of trucks, automobiles, and planes. While freight railroads continue to play an important role in the United States, there are thousands of miles of abandoned railroad tracks.

An abandoned railway is one that is no longer used for its original purpose, to provide a travel path for trains with such abandonments due to reasons including historical, financial, or government reasons. However, even when the railroad tracks no longer have a financial, economic, or social value, the owners of the tracks are reluctant to officially abandon the tracks. One reason is that in the United States, under the Abandoned Railroad Right of Way Act (43 U.S.C. § 912), land given by the United States for use of a railroad right-of-way in which the United States retained a right of reverter which had to be turned into a public highway within one year of the railroad company abandonment or be given to adjacent landowners. Therefore, the track owner loses the property right. In order to incentivize track owners to officially abandon tracks and repurpose the land and tracks, the United States passed the Railroad Revitalization and Regulatory Reform Act in an effort to promote the conversion of abandoned lines to trails. Under this legislation, the United States government can offer financial, educational, and technical assistance to local, state, and federal agencies that wish to convert the tracks.

Further, the abandonment could be delayed for up to 180 days after an order of abandonment, unless the property was first offered for sale on reasonable terms for public purposes including recreational use. Further, legislation attempted to regulate, control, and otherwise effect the abandonment of railroad tracks. However, these legislative attempts only resulted in the creation of numerous legal issues for adjacent landowners, including a mix of federal and state laws. In addition, fencing issues get involved and those may not be handled under the general fencing laws of the particular state, but in accordance with fencing provisions specific to the conversion of abandoned rail lines to trails.

While most abandoned railroad tracks lay dormant, they remain under the ownership of the abandoning railroad company. This ownership can create controversies including property disputes when the land, under the official abandonment process, returns to adjacent landowners. Another option is to convert the tracks to use of a trail because the once-abandoned travel path is now available to the public while also preserving the right of the track owners to use the tracks for future train use. Some "abandoned" railways have been refurbished and returned to active railroad routes. Therefore, abandoned tracks have been used in a manner where the railroad operation has lost its right to reuse the tracks because it has become undesirable.

Nevertheless, the circumstances and laws effecting railroad tracks has resulted in thousands of miles of abandoned railroad lines that lie dormant across North America that once served commerce and emerging economies. Now neglected and in various states of disrepair, these corridors are an eyesore for the communities which once built the thriving economies.

To prevent the loss of the future right to reinstate the tracks for train use, track owners engage in a practice called railbanking. Railbanking is the process of forming an agreement between a railroad company (track owner) and a trail agency to use an out-of-service railroad track as a trail (e.g., walking, biking, etc.) until a railroad needs the corridor for rail service. This interim trail use of railbanked corridors has contributed to the thousands of miles of rail corridors that would otherwise have been officially abandoned. Further, railbanking prevents the railroad from losing its Railroad Right of Way (RROW). It would be advantageous for a system to be put in place that easily converts tracks no longer being used for trains into trail use while preserving the RROW.

Historically, when a rail-to-trail project was commenced, the design was to grade the rail trail and cover it in gravel or crushed stone. Some are paved with asphalt and others are left as dirt. In each case, the ability to easily convert the trail back to rail becomes expensive, time consuming, and otherwise challenging, if not impossible. Removing the rail bed infrastructure also removes the installed drainage that can lead to flooding. Keeping the rail bed infrastructure in place retains the originally designed hydraulic relief. Additionally, the requirement for surface excavation is either unnecessary or limited that could expose environmental concerns from rail tank cars that may have leaked over time.

Accordingly, it is an object of the present invention to provide a system for converting a railroad track to a trail using a trail mat system that quickly and easily mounts to the rails and which can be quickly and easily removed if railroad service is to be restored without requiring any changes to infrastructure of the railroad track.

BRIEF SUMMARY OF THE INVENTION

The above objective is accomplished according to the present invention by providing a trail mat system for converting existing railroad tracks to trails, comprising a mat extending between and on top of a pair of railroad track rails; at least one rail clamp section disposed on a bottom side of the mat including a rail cavity for receiving at least a portion of the rails; at least one clamp arm included in the rail clamp section engaging one of the rails; and, a securing fastener operatively associated with at least one clamp arm to bias the clamp arm against the rail to prevent separation of the mat from the rails; whereby the mat is configured to be placed over and removably secured to the rails to provide a trail surface overtop the rails without removing the rails or other elements of the railroad track. Physical clamping to the existing rail transmits load linearly to the rail prohibiting cantilevered action of the surface, or floatation within an active flood event.

In a further advantageous embodiment, the mat comprises a recyclable material and is constructed and arranged to support equivalent design loads as the supporting rail bed ties when mounted on the rails.

In a further advantageous embodiment, the rail clamp section includes a first clamp arm laterally spaced from a second clamp arm, wherein the first and second clamp arms extend vertically from the bottom side of the mat and define the rail cavity; and a laterally extending arm portion disposed on each of the first and second clamp arms, wherein the laterally extending arm portions engage a fillet of a rail head on the rails to resist upward movement of the mat.

In a further advantageous embodiment, the securing fastener extends through the first and second clamp arms and is operatively associated to draw the first and second clamp arms together to bias the laterally extending arm portions against the rails.

In a further advantageous embodiment, a confined utility space is defined by the bottom side of the mat and between the rails for receiving utility lines and various conduits in a secure area underneath the mat.

In a further advantageous embodiment, the clamp arm includes a laterally extending arm portion engage a fillet of a rail head on a first side of the rail, and wherein the clamp arm extends over the rail head and includes a vertically extending arm portion adjacent a second side of the rail and engaging the securing fastener.

In a further advantageous embodiment, the securing fastener is disposed in a horizontal channel extending from an exterior side surface of the mat to the rail cavity to engage the vertically extending arm portion of the clamp arm, wherein the securing fastener draws the clamp arm laterally to bias against the rail.

In a further advantageous embodiment, the clamp arm includes a first C-shaped arm portion and a second C-shaped arm portion, wherein each of the C-shaped arm portions include a laterally extending arm portion engage a fillet of a rail head arranged on opposite sides of the rail, and wherein each of the C-shaped arm portions include a second lateral portion extending over the rail head in an overlapping arrangement and engaging the securing fastener.

In a further advantageous embodiment, the securing fastener is disposed in a vertical channel extending from a top surface of the mat to the rail cavity to engage the second lateral portions of the C-shaped arm portions, wherein the securing fastener draws the clamp arm vertically to bias against the rail.

In a further advantageous embodiment, a connecting member is interconnecting a first mat to a second mat.

In a further advantageous embodiment, the connecting member includes at least one of a bolt, cable, and combinations thereof, extending horizontally through a cavity in the mats.

In a further advantageous embodiment, the connecting member includes a projection disposed on a side surface of the first mat and a complementary recess disposed on a side surface of the second mat, wherein the projection is received into the complementary recess to interconnect the first and second mats.

In a further advantageous embodiment, surface traction members are disposed on a top surface of the mat for enhanced traction.

In a further advantageous embodiment, the surface traction members are selected from the group consisting of ridges, grooves, dimpling, raised or recessed repeating shapes, characters, figures, and combinations thereof.

The above objective is further accomplished according to the present invention by providing a trail mat system for converting existing railroad tracks to trails, comprising a mat extending between and on top of a pair of railroad track rails; at least one rail cavity disposed on a bottom side of the mat receiving at least a portion of the rails; and, a securing fastener carried by the mat adjacent at least one of the rails, wherein the securing fastener is operable between a retracted position allowing the rail to enter and exit the rail cavity, and an extended position biased against the rail to prevent the rail from exiting the rail cavity; whereby the mat is configured to be placed over and removably secured to the rails to provide a trail surface overtop the rails without removing the rails or other elements of the railroad track.

In a further advantageous embodiment, the securing fastener is disposed in a horizontal channel extending from an exterior side surface of the mat to the rail cavity, wherein the securing fastener pushes against a first side of the rail to draw a sidewall of the rail cavity against an opposite side of the rail to laterally bias against the rail.

In a further advantageous embodiment, the securing fastener comprises a bolt disposed in a horizontal channel and extends into the rail cavity; wherein the bolt is spring biased at a first end of the channel for directing the bolt into the rail cavity so that a second end of the bolt engages one of the rails when the rail is received in the rail cavity.

In a further advantageous embodiment, securing fastener comprises a Bernoulli spiral cam clamp rotatably carried on the bottom side of the mat, wherein the cam clamp rotates to laterally bias against the rail.

The above objective is further accomplished according to the present invention by providing a trail mat system for converting existing railroad tracks to trails, comprising a first mat extending between and on top of a pair of railroad track rails, a second mat extending between and on top of a pair of railroad track rails; a connecting member interconnecting the first mat to the second mat; a confined utility space defined by a bottom side of the mats and between the rails for receiving utility lines and various conduits in a secure area underneath the mats; at least one rail clamp section disposed on the bottom side of the mat including a rail cavity for receiving at least a portion of the rails; at least one clamp arm included in the rail clamp section engaging one of the rails, wherein the clamp arm includes a laterally extending arm portion engage a fillet of a rail head on the rail; and, a securing fastener operatively associated with the at least one clamp arm to bias the clamp arm against the rail to prevent separation of the mat from the rails; whereby the mat is configured to be placed over and removably secured to the rails to provide a trail surface overtop the rails without removing the rails or other elements of the railroad track.

BRIEF DESCRIPTION OF THE SEVERAL VIEWS OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
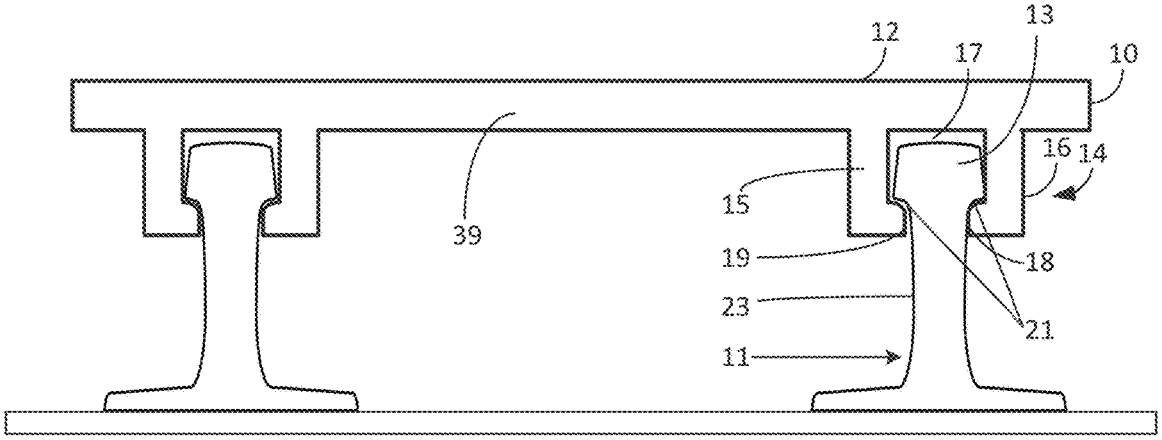
FIG. 1 is a front elevation view of a trail mat system according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, figures and all reasonable inferences to be drawn therefrom, alone or with consideration of the references incorporated herein.

DETAILED DESCRIPTION OF THE INVENTION

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

This trail mat system of the present invention allows for railroad tracks to be used for trails and to promote projects for converting tracks to trails without removal or modification of the existing railroad tracks. In one structure, the track owner can enter a lease regarding the tracks and associated property to allow the tracks to be used by the community and to lease the easement for trails. The agreement can include a condition where the track owner has the rights to restore the tracks to train use in the future. The track owner can also shift the maintenance of the tracks and property to the lessee.

To facilitate such a structure, this trail mat system provides for existing rails, ballast, ties, and all infrastructure to remain in place and be covered by a mat that can be made from recycled plastics, composites, concrete, timber, and any combination thereof or any other suitable materials. The system can be modular so that the former rail path remains intact while providing a trail superimposed over top of the rails of the railroad track. Because the trail mat system is installed without the need to remove the rails, ties, connections, ballast, etc., the existing railroad track infrastructure remains intact and avoided environmental concerns with removing or disturbing such elements that may contain pollution. The system also allows for the removal of the trail mat system if the track owners wish to restore the railroad tracks to train service, in which case the mats of the present system can be quickly and easily removed and recycled for additional projects.

Figure 2:
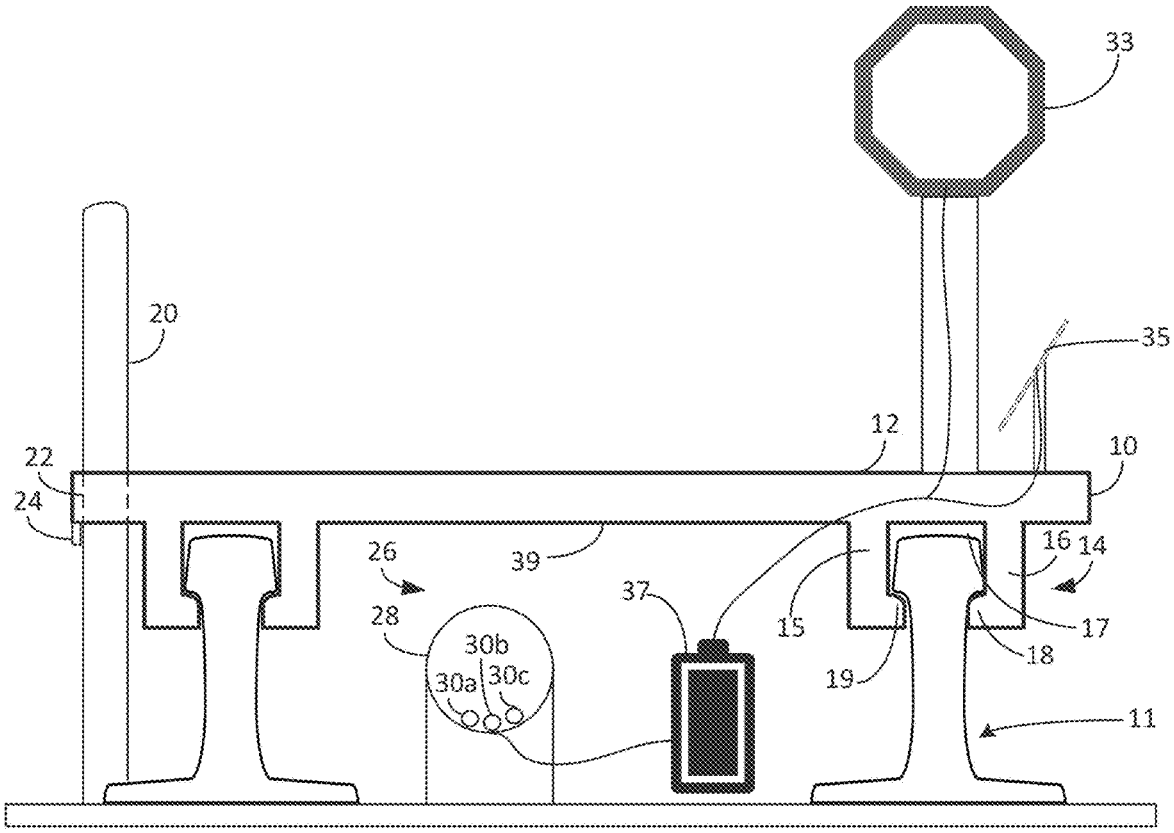
FIG. 2 is a front elevation view of a trail mat system including various accessories according to the present invention.

Referring to FIGS. 1 and 2, a mat 10 is shown extending between and on top of a pair of railroad track rails 11. Mat 10 can include a top surface 12 and rail clamp section 14 disposed on a bottom side of mat 10. In the illustrated embodiment, mat 10 includes a pair of rail clamp sections 14, one for each rail 11 of the railroad track. The rail clamp section 14 includes a rail cavity 17 for receiving at least a portion of rails 11. In one embodiment with further reference to FIG. 6, the rail cavity 17 is configured to receive the head portion 13 of a railroad track rail 11.

In the embodiment of FIGS. 1-5 and 7, a pair of clamp arms is included in each rail clamp section 14 engaging one of rails 11, respectively. In the illustrated embodiment, the rail clamp section 14 includes a first clamp arm 16 laterally spaced from a second clamp arm 15, wherein the first and second clamp arms extend vertically from the bottom side 39 of mat 10 and define the rail cavity 17. A laterally extending arm portion 18, 19 is disposed on each of the first and second clamp arms, respectively. Referring to FIG. 6, one embodiment of a rail 11 of a track is shown with its components defined for context for interaction with the mat 10 of the present invention. The laterally extending arm portions 18, 19 engage a fillet 21 and/or web 23 (FIG. 6) of rail head 13 to resist upward movement of the mat 10. The clamp arms can be configured to be positioned above a fishing plate that interconnects rail sections. The clamp arms 15, 16 are resilient yet flexible so that the clamp arm laterally extending portions 18, 19 can expand outward or inward relative to the rail 11 and be based against the rails 11 securing the mat 10 to the rails 11. The mat is positioned on top of the existing rail contour and dimension. In one embodiment, the mat 10 is installed on the top of the existing rail so that the mat top surface retains the same profile elevation and is consistent rail to rail through both straight-aways and curves.

The clamp arms are configured to secure the mat 10, while also being removable from an existing rail, and reduces or prevents movement, buckling or shifting of the top surface. The mat 10 can have a flat top surface 12 consistent in manufactured dimension from mat to mat and is preferably comprised of 100% recycled materials, such as plastics. The mat 10 can have the same load strength as existing wooden ties and can be configured to withstand railroad tie design loads when mounted on rails 11 using recycled materials such as plastic. In one example embodiment, the mat 10 or components thereof can be made from recycled material that meet or exceed American Railway Engineering and Maintenance-of-Way (AREMA) standards.

The manufacturer and construction of the mat 10 can resist or prevent interaction with environmental elements that can lead to that mat being resistant or impervious to rusting, splintering, crumbling, rotting, absorbing moisture, or leaching toxic chemicals into the environment. The mat 10 can resist or be impervious to infestation by insects and resist or be impervious to wet weather when made using recycled materials such as plastic.

The mat 10 can further be configured to drain quickly when arranged as a boardwalk surface. For example, when installed, the mat 10 can include a cross slope in the range of 0.5 to 5 inches laterally to assist with drainage of fluid from the top surface 12 of the mat 10. The width of the mat can be in the range of 1 to 25 feet. The length of the mat 10 can be in the range of less than 1 foot to approximately 30 feet. The vertical clearance of a path defined within the width of the mat 10 can be excessed 5 feet, which is relative to the top surface 12 of the mat 10. The top surface 12 can have a generally flat section that is disposed over the tracks and a sloped of otherwise contoured section extending laterally from the generally flat section. The mat can include two levels creating a step like structure along the width or length of the mat 10.

Figure 4:
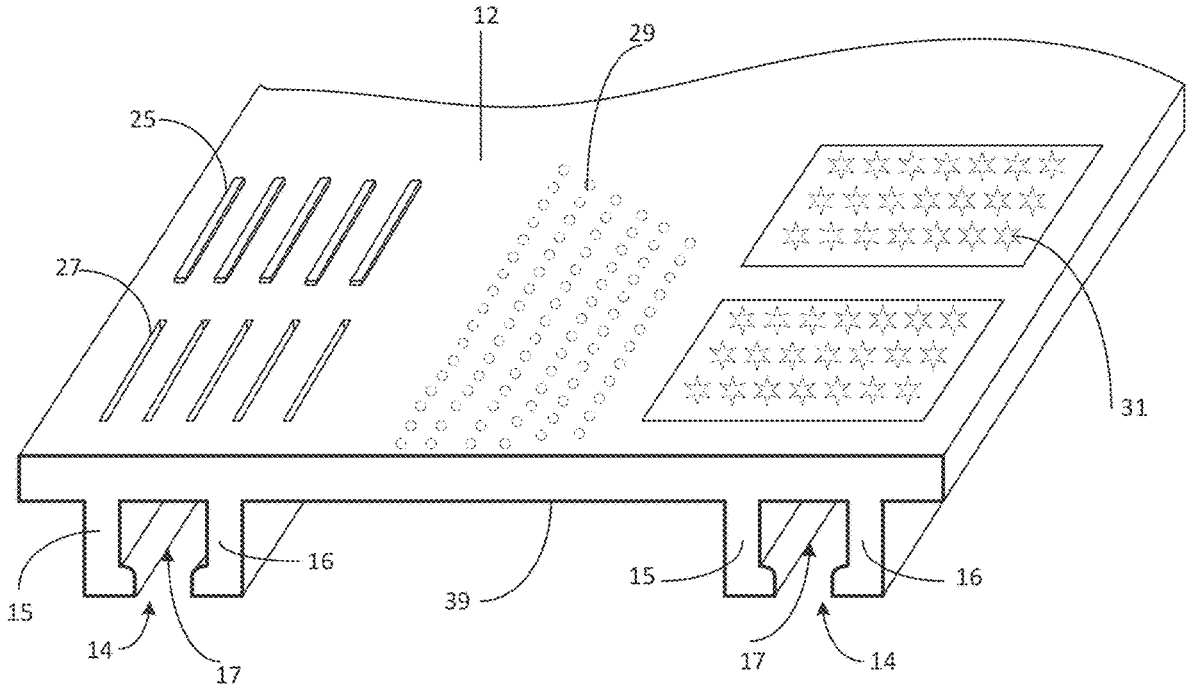
FIG. 4 is top perspective view of portion of a trail mat according to the present invention.

The mat can reduce or remove the chance of ponding water and/or ice using various surface features. For example, the top surface 12 or deck can include wet weather surface traction members disposed on top surface 12 of the mat 10 to provide enhanced traction for pedestrians, cyclists, and others. Referring to FIG. 4, in the illustrated example embodiment, the surface traction members can include but are not limited to ridges 25, grooves 27, dimpling 29, raised or recessed repeating shapes 31, characters, figures, and combinations thereof. The top surface 12 can also be equipped with lifetime truncated dome median warning stripes for ADA compliance in ADA approved colors.

Referring to FIG. 2, the top surface can permit the installation of side curb 20 and/or railings, and bollards. Mileage or other signage can be attached to the mat 10 as desired, and for example, inserted and secured through opening 22. The mats can be electronically connected to each other using contacts or wires to power various accessory items, for example, LED trail lighting 24.

Since the area between existing rails 11 is maintained and unincumbered, a confined utility space 26 is defined by the bottom side 39 of the mat 10 and between the rails 11 for receiving utility lines and various conduits in a secure area underneath the mat 10. Thus, it can serve to house conduit 28 and/or can include other lines such as utilities fiber optic cable 30*a*, electrical conduit 30*b*, water 30*c*, natural gas and/or other utilities. These lines can be within the conduit 28 in space 26 or separate. This enables a protected and maintained "vault" for ease of access, ingress and egress of the lines. Current or future trail monitoring, emergency call stations, etc. could emanate from this utility space and infrastructure contained in the space. For example, as shown in FIG. 2, electrically operated signage, such as a crosswalk signal or other traffic control signal 33, can be operatively associated with a solar power panel 35 mounted to mat 10. The traffic control signal 33 and solar power panel 35 can further be operatively associated with a batter backup unit 37 contained in confined utility space 26 and connected to utility power lines in conduit 28 to ensure uninterrupted operation.

Figure 3:
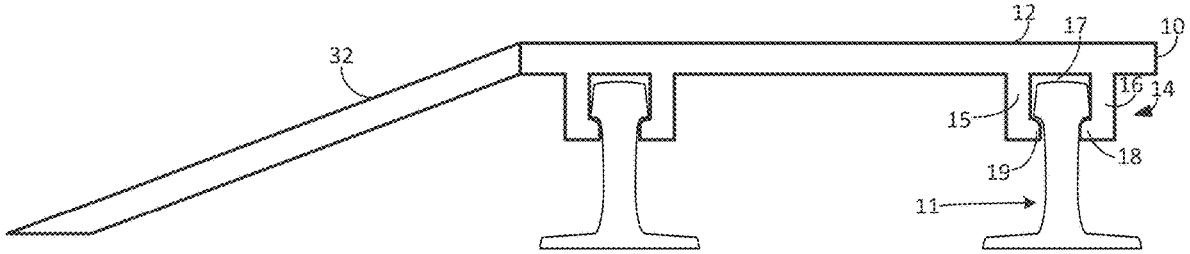
FIG. 3 is a front elevation view of a trail mat system including an access ramp according to the present invention.

Referring to FIG. 3, ADA pedestrian and bicycle access ramp 32 is removable attached or incorporated into the mat 10 and can be constructed from the same recyclable material as mat 10. The ramp can be disposed at a break in the curb or railing. The ramp 32 can be removed along with the mat if the track owner wishes to reactivate the track for train use. The mat 10 can then be removed, relocated, or recycled for future trail developments.

Figure 5:
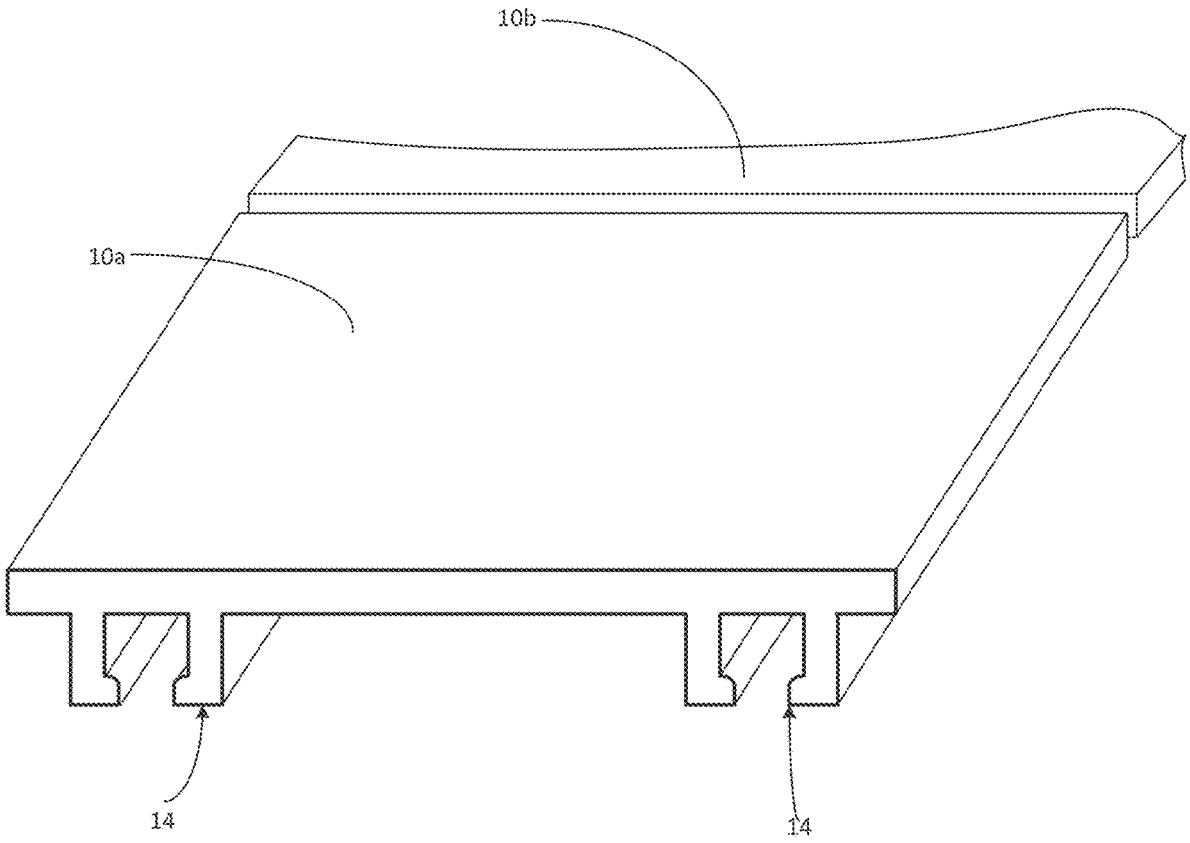
FIG. 5 is top perspective view of a plurality of trail mats according to the present invention.
Figure 6:
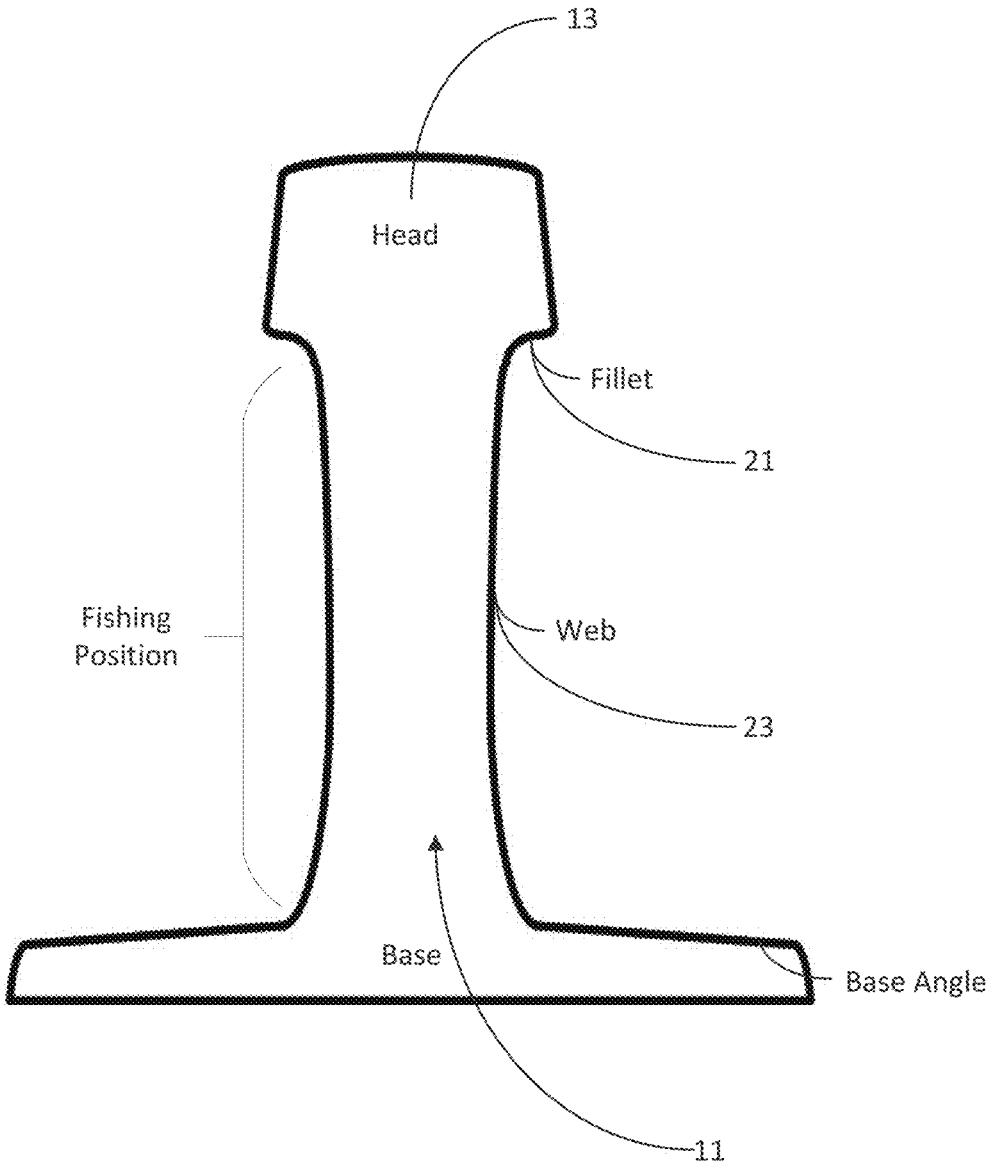
FIG. 6 is a front elevation view of a rail on which a trail mat mounts according to the present invention.

Referring to FIG. 5, the mat 10 can be included in a set of mats that when arranged adjacent to each other make a boardwalk that can be used for a trail.

Figure 7:
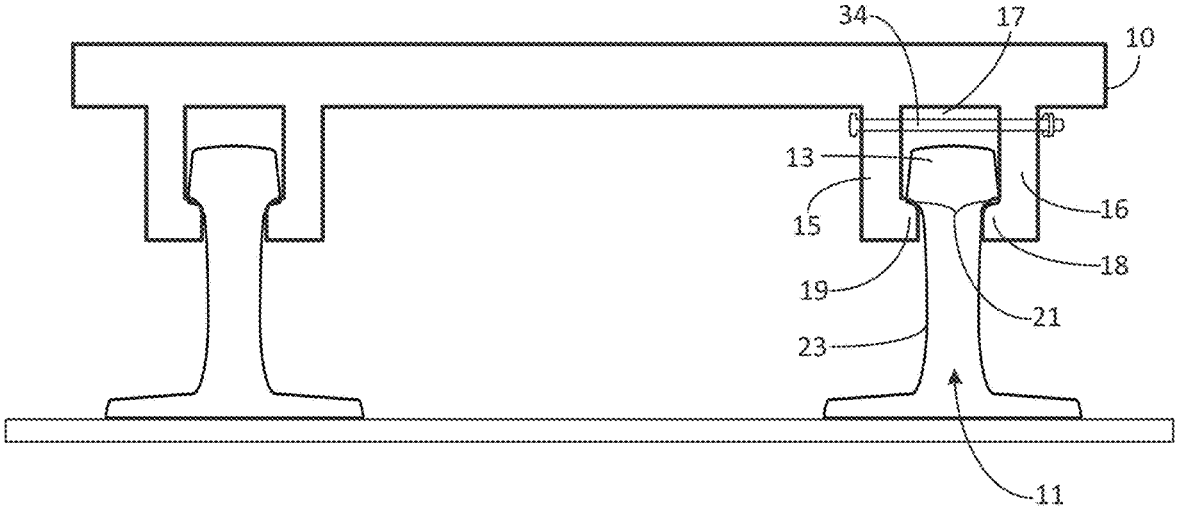
FIG. 7 is a front elevation view of a trail mat system according to the present invention.

Referring to FIG. 7, in one embodiment, mat 10 is further secured to the rail using a securing fastener 34. The securing fastener 34 is operatively associated with the at least one clamp arm disposed in the rail clamp section 14 to bias the clamp arm against the rail to prevent separation of the mat 10 from the rails. In this embodiment, the securing fastener 34 can compress the clamp arms 15, 16 around the rail 11. In the illustrated embodiment, the securing fastener 34 extends through the first and second clamp arms 15, 16 and rail cavity 17. In this arrangement, securing fastener 34 is operatively associated to draw the first and second clamp arms 15, 16 together to bias the laterally extending arm portions 18, 19 against the rails 11.

Figure 8:
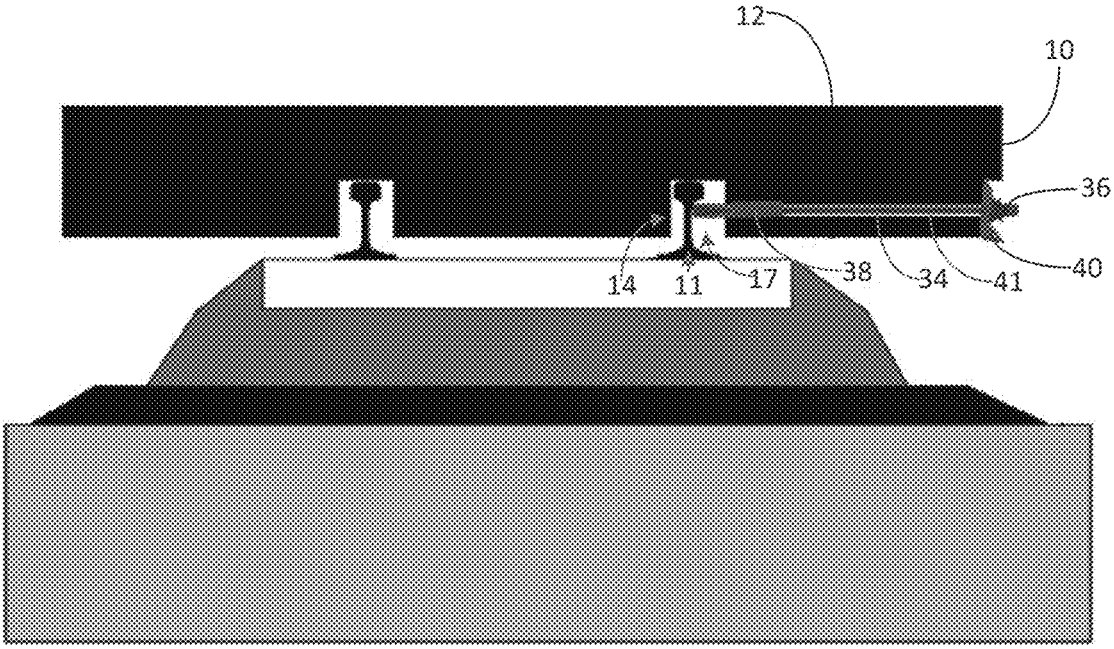
FIG. 8 is a cut-away front elevation view of a trail mat system according to the present invention.

Referring to FIG. 8, another mat is shown that can be placed on the existing track without the need to remove the rails, fishing plates, sleeper, ballast, grade crossing, or other component of the railroad track infrastructure. In this arrangement, a securing fastener 34 is carried in a horizontal cavity 41 within mat 10. The securing fastener 34 is operable between a retracted position allowing said rail to enter and exit rail cavity 17, and an extended position engaging rail 11 to prevent the rail from exiting rail cavity 17. In the illustrated embodiment, mat 10 includes a rail clamp section 14 in which rail cavity 17 is defined in the undersurface from the bottom side 39 of the mat 10 and configured to receive the rail 11. When the rail 11 is received in the rail cavity 17, a securing fastener 34 extends from an outer edge of the mat 10, through horizontal cavity 41 and extend into the rail cavity 17. The securing fastener 34, when in the extended position, applies pressure to the side (web 23, FIG. 6) of rail 11 to bias one wall of the rail cavity 17 against the rail 11. The securing fastener 34 can be disposed under the head 13 of the rail so that the applied force of fastener 34 resist any upward movement of mat 10 on rail 11. In the illustrated embodiment, securing fastener 34 comprises a bolt. The bolt can alternate from left-to-right sides of the existing rails as needed along the path parallel to the rails 11 to secure the mat 10 to the rails. The fastener can include a head 36 configured to accept a tool to rotate the securing fastener 34. Threads on the securing fastener 34 can engage with a threaded portion 38 that can be included in or carried by the horizontal cavity 41 of mat 10. A washer 40 can be used to apply force across a side of the mat 10 by the head 36 of securing fastener 34.

Figure 9:
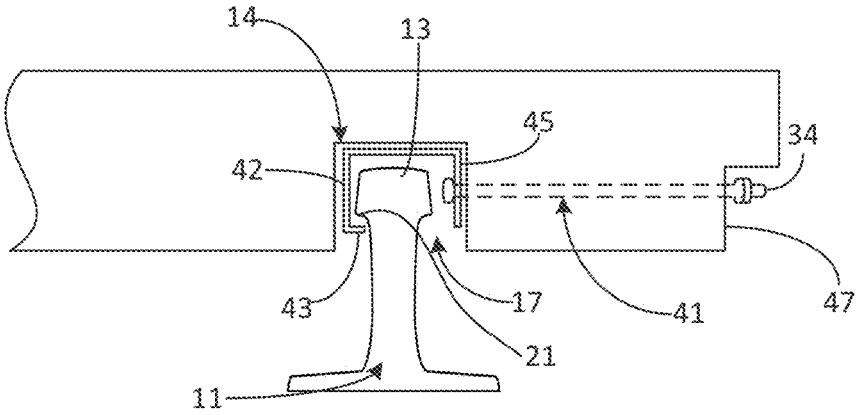
FIG. 9 is a front elevation view of a portion of a trail mat system according to the present invention.

Referring to FIG. 9, in a further embodiment, a contoured clamp arm 42 includes a laterally extending arm portion 43 engage a fillet 21 (FIG. 6) of a rail head 13 on a first side of the rail 11, and then extends over the rail head 13 and includes a vertically extending arm portion 45 adjacent a second side of the rail 11 which engages the securing fastener 34. The securing fastener 34 is disposed in a horizontal cavity 41 extending from an exterior side surface of the mat 10 to the rail cavity 17 to engage the vertically extending arm portion 45 of the clamp arm 42. The securing fastener 34 draws the clamp arm 42 laterally to bias against the side of rail 11 under rail head 13. In the illustrated embodiment, the securing fastener 34 comprises a bolt that when tightened against outside surface 47 of mat 10, the contoured clamp arm 42 is biased against the rail 11, securing the mat 10 to the rail 11.

Figure 10:
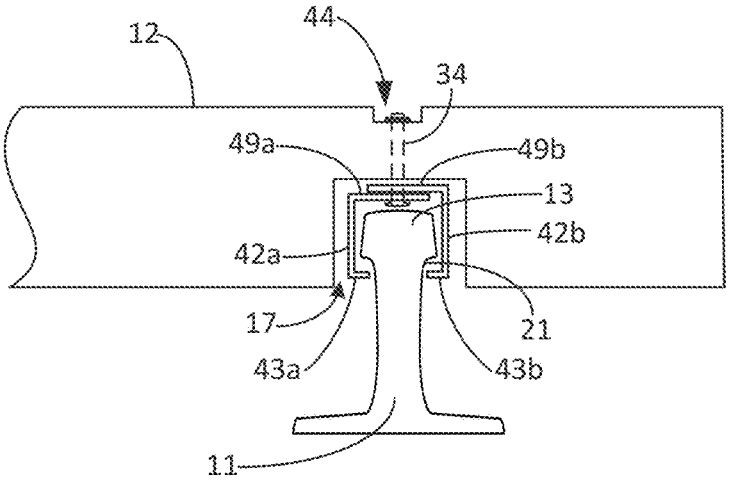
FIG. 10 is a front elevation view of a portion of a trail mat system according to the present invention.

Referring to FIG. 10, in a further embodiment, the clamp arm 42 includes a first C-shaped arm portion 42*a* and a second C-shaped arm portion 42*b*. Each of the C-shaped arm portions include a laterally extending arm portion 43*a*, 43*b* engaging a fillet 21 of a rail head 13 arranged on opposite sides of the rail 11. Each of the C-shaped arm portions 42*a*, 42*b* include a second lateral portion 49*a*, 49*b* extending over the rail head 13 in an overlapping arrangement and engaging the securing fastener 34. The securing fastener 34 is disposed in a vertical channel 44 extending from a top surface 12 of the mat 10 to the rail cavity 17 to engage the second lateral portions 49*a*, 49*b* of the C-shaped arm portions 42*a*, 42*b*. When tightened against top surface 12, the securing fastener 34 draws the clamp arm vertically to bias against the fillet 21 of rail head 13 on rail 11.

Figure 11:
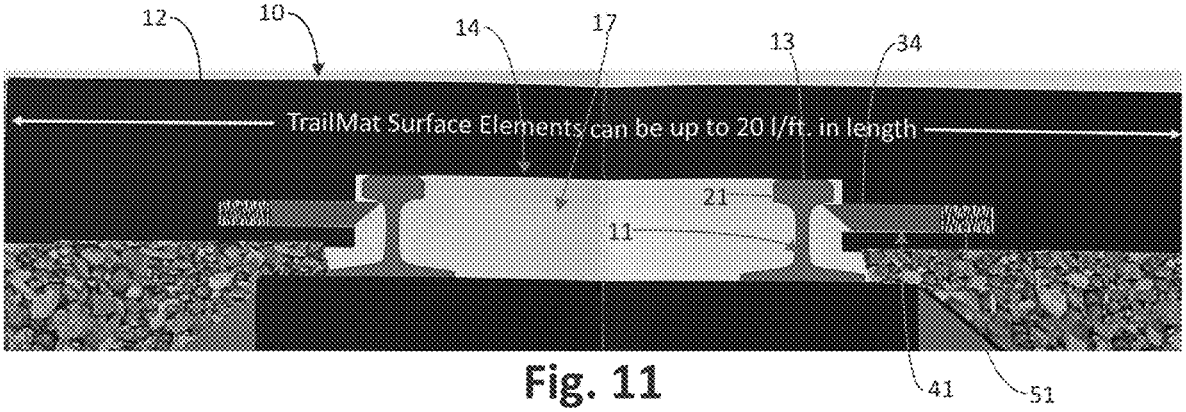
FIG. 11 is a cut-away front elevation view of a trail mat system according to the present invention.

Referring to FIG. 11, in the illustrated embodiment, the securing fastener 34 comprises a bolt disposed in a horizontal channel 41 and extends into the rail cavity 17. The bolt is spring biased by spring 51 at a first end of the channel for directing the bolt into the rail cavity 17 so that a second end of the bolt engages against the fillet 21 of rail head 13 on at least one of rails 11. In this embodiment, rail cavity 17 encompasses both rails 11 and a spring biased bolt is disposed on both sides for engaging each of rails 11.

Figure 14:
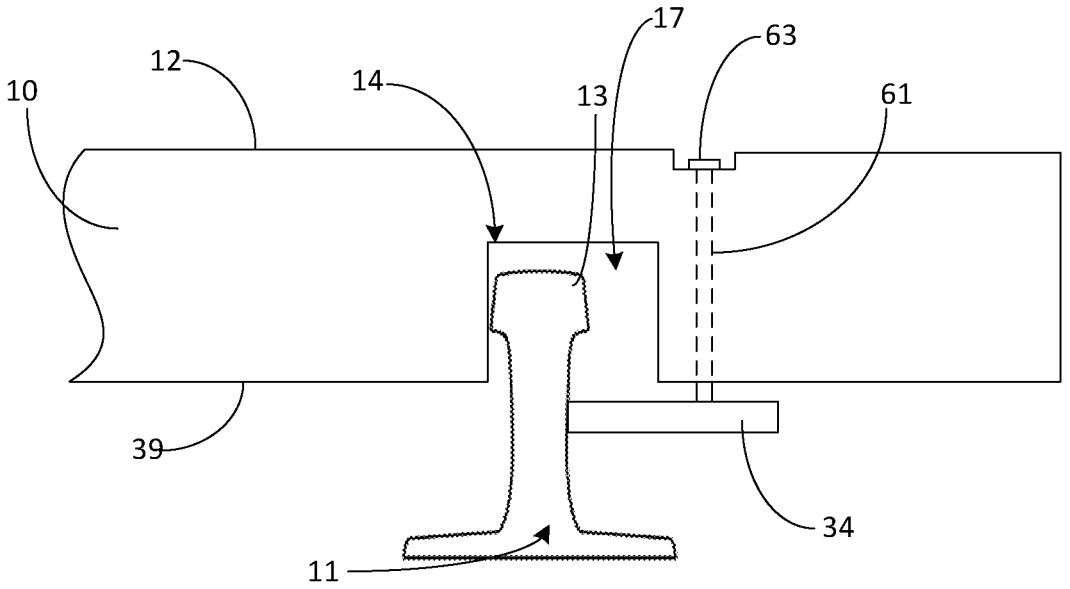
FIG. 14 is a front elevation view of a portion of a trail mat system according to the present invention; and, FIG. 15 is a perspective view of a cam clamp according to the present.
Figure 15:
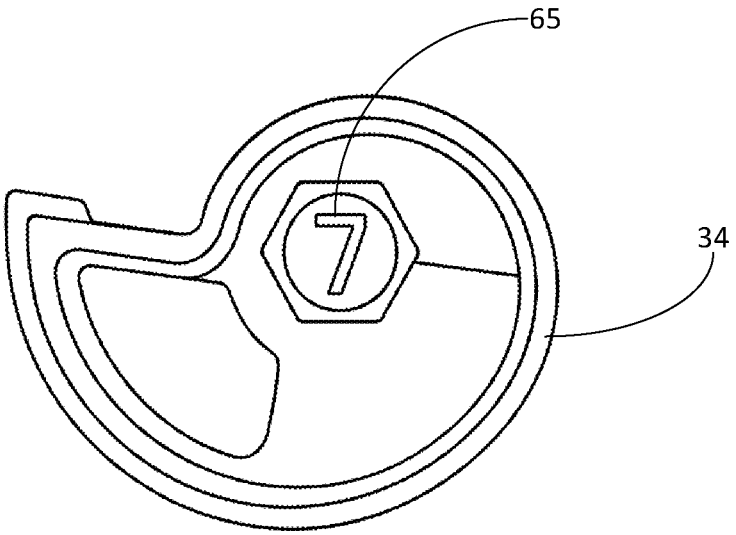

Referring to FIGS. 14 and 15, in one example embodiment, securing fastener 34 comprises a Bernoulli spiral cam clamp. The cam clamp 34 is rotatably carried on the bottom side of mat 10 by a rod 61 extending vertically through mat 10 from top surface 12 to bottom side 39. Cam clamp 34 is rotated by turning bolt head 63. As shown in FIG. 14, cam clamp 34 is rotated to laterally bias against the rail 11. A cam clamp 34 can be used on each rail to secure the mat to the rails. Cam clamp 34 can be rotated to disengage from rail 11 to allow rail 11 to enter and exit rail cavity 17. As shown in FIG. 15, cam clamp 34 can further include a rotation head 65 constructed and arranged to receive a tool, such as a wrench, to engage and rotate cam clamp 34 to engage and disengage rail 11.

Figure 12:
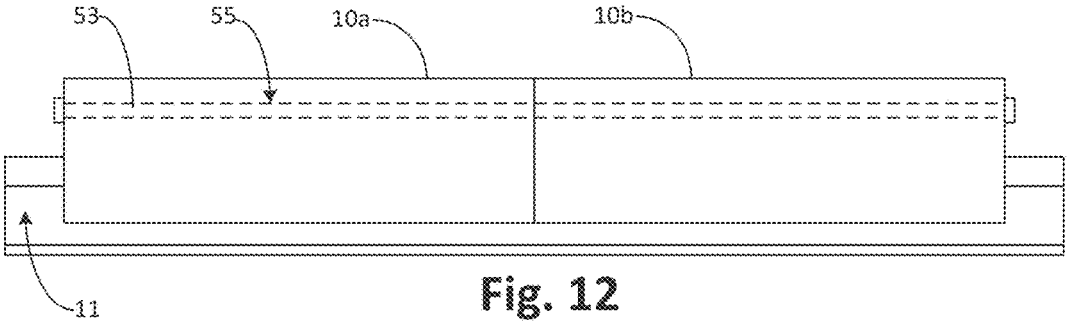
FIG. 12 is a side elevation view of a trail mat system according to the present invention.
Figure 13:
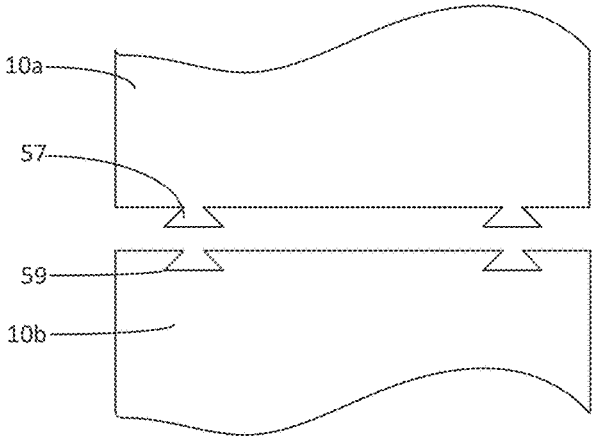
FIG. 13 is a top view of a trail mat system according to the present invention.

Referring to FIGS. 12 and 13, a connecting member 53 is included for interconnecting a first mat 10*a* to a second mat 10*b*. In the embodiment of FIG. 12, connecting member 53 includes at least one of a bolt, cable, and combinations thereof, extending horizontally through a cavity 55 in the mats 10, 10*b*. In a further embodiment as shown in FIG. 13, the connecting member 53 includes a projection 57 disposed on a side surface of the first mat 10*a* and a complementary recess 59 disposed on a side surface of the second mat 10*b*. The projection 57 is received into the complementary recess 59 to interconnect the first and second mats 10*a*, 10*b*. In the example embodiment of FIG. 13, the interconnecting members comprise a dovetailed connecting arrangement.

In one embodiment, ballast can be added around and under the mat if there is a desire for additional drainage, barrier, support, aesthetic, ingress/egress, safety and or other functionality of ballast. The system can be used when rails 11 are taken from the group consisting of double headed, bull headed, flat-footed and any combination thereof.

Trails that result from the design and implementation of the trail mat systems detailed herein improve the existing technology of the rails-to-trails programs and can preserve the existing corridor during both installation and removal. As discussed, the trail mat system herein allows for the cooperation or sharing of space with linear utilities that can include utilities such as pipelines, electrical transmission wires, and telephone lines in the confined utility space 26 underneath the mats 10. Further, the trail mat system herein can be installed on ground support rails as well as bridges. This system completely covers the rails of the track to avoid creating any unnecessary danger to the user and increased liability to the owners and operators from exposed railroad tracks. Further, this system can reduce or prevent erosions issue that are normally associated with railroad tracks.

In one embodiment, the mat material can comprise a composite material including, for example, lignin, cellulose, and various hemi-celluloses as well as a polymer or copolymer either alone or in some combination. The mat may be composed of mixture of wood fiber, plastic, and some type of binding agent. The material can include a thin veneer like layer or a cap to provide protection for the material underneath. The surface can be smooth, grooved, rough and any combination. The mat can include polyethylene, poly vinyl chloride (PVC), zinc oxide, $TiO_2$, $CaCo_3$, UV Additive, coloring, stabilizer, and suitable substitutes. The mat can include thermoplastics that can be recycled and can be from a recycle source. The mat material can include plastic obtained primarily from reclaimed/recycled grocery bags and stretch film.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. A trail mat system for converting existing railroad tracks to trails, comprising:

a mat extending between and on top of a pair of railroad track rails;

at least one rail clamp section disposed on a bottom side of said mat including a rail cavity for receiving at least a portion of said rails;

at least one clamp arm included in said rail clamp section engaging one of said rails; and, a securing fastener operatively associated with said at least one clamp arm to bias said clamp arm against said rail to prevent separation of said mat from said rails;

whereby said mat is configured to be placed over and removably secured to said rails to provide a trail surface overtop the rails without removing said rails or other elements of the railroad track wherein said rail clamp section includes a first clamp arm laterally spaced from a second clamp arm, wherein said first and second clamp arms extend vertically from said bottom side of said mat and define said rail cavity; and a laterally extending arm portion disposed on each of said first and second clamp arms, wherein said laterally extending arm portions engage a fillet of a rail head on said rails to resist upward movement of said mat; and, wherein said securing fastener extends through said first and second clamp arms and is operatively associated to draw said first and second clamp arms together to bias said laterally extending arm portions against said rails.

2. The trail mat system of claim 1 wherein said mat comprises a recyclable material and is constructed and arranged to support equivalent design loads as the supporting rail bed ties when mounted on said rails.

3. The trail mat system of claim 1 including a confined utility space defined by said bottom side of said mat and between said rails for receiving utility lines and conduits in a secure area underneath said mat.

4. The trail mat system of claim 1 wherein:

the clamp arm includes a laterally extending arm portion that engages a fillet of a rail head on a first side of the rail;

wherein the clamp arm extends over the rail head; and, wherein the clamp arm includes a vertically extending arm portion adjacent a second side of said rail that engages the securing fastener.

5. The trail mat system of claim 4 wherein said securing fastener is disposed in a horizontal channel extending from an exterior side surface of said mat to said rail cavity to engage said vertically extending arm portion of said clamp arm, wherein said securing fastener draws said clamp arm laterally to bias against said rail.

6. The trail mat system of claim 1 wherein said clamp arm includes a first C-shaped arm portion and a second C-shaped arm portion, wherein each of said C-shaped arm portions include a laterally extending arm portion engage a fillet of a rail head arranged on opposite sides of said rail, and wherein each of said C-shaped arm portions include a second lateral portion extending over said rail head in an overlapping arrangement and engaging said securing fastener.

7. The trail mat system of claim 6 wherein said securing fastener is disposed in a vertical channel extending from a top surface of said mat to said rail cavity to engage said second lateral portions of said C-shaped arm portions, wherein said securing fastener draws said clamp arm vertically to bias against said rail.

8. The trail mat system of claim 1 including a connecting member interconnecting a first mat to a second mat.

9. The trail mat system of claim 8 wherein said connecting member includes at least one of a bolt, cable, and combinations thereof, extending horizontally through a cavity in said mats.

10. The trail mat system of claim 8 wherein said connecting member includes a projection disposed on a side surface of said first mat and a complementary recess disposed on a side surface of said second mat, wherein said projection is received into said complementary recess to interconnect said first and second mats.

11. The trail mat system of claim 1 including surface traction members disposed on a top surface of said mat for enhanced traction.

12. The trail mat system of claim 11 wherein said surface traction members are selected from the group consisting of ridges, grooves, dimpling, raised or recessed repeating shapes, characters, figures, and combinations thereof.

13. A trail mat system for converting existing railroad tracks to trails, comprising:

a mat extending between and on top of a pair of railroad track rails;

at least one rail cavity disposed on a bottom side of said mat receiving at least a portion of said rails; and, a securing fastener carried by said mat adjacent at least one of said rails, wherein said securing fastener is operable between a retracted position allowing said rail to enter and exit said rail cavity, and an extended position biased against said rail to prevent said rail from exiting said rail cavity;

whereby said mat is configured to be placed over and removably secured to said rails to provide a trail surface overtop the rails without removing said rails or other elements of the railroad track; and, wherein said securing fastener is disposed in a horizontal channel extending from an exterior side surface of said mat to said rail cavity, wherein said securing fastener pushes against a first side of said rail to draw a sidewall of said rail cavity against an opposite side of said rail to laterally bias against said rail.

14. The trail mat system of claim 13 wherein said securing fastener comprises a bolt disposed in a horizontal channel and extends into said rail cavity; wherein said bolt is spring biased at a first end of said channel for directing said bolt into said rail cavity so that a second end of said bolt engages one of said rails when said rail is received in said rail cavity.

15. The trail mat system of claim 13 wherein said securing fastener comprises a Bernoulli spiral cam clamp rotatably carried on said bottom side of said mat, wherein said cam clamp rotates to laterally bias against said rail.

* * * * *